US006027232A

United States Patent [19]

Lin

[11] Patent Number: 6,027,232

[45] Date of Patent: Feb. 22, 2000

[54] PROTECTIVE SCREEN STRUCTURE ADAPTED FOR USE ON FLOOR LAMPS HAVING A SOURCE OF LIGHT ORIENTING UPWARDLY

[76] Inventor: Shih-Ming Lin, No. 132, Hsi Hsin Street, Chang Hua Hsien, Taiwan

[21] Appl. No.: 09/186,634

[22] Filed: Nov. 6, 1998

[51] Int. Cl.[7] ..... F21V 7/00; F21V 15/02

[52] U.S. Cl. ..... 362/376; 362/410; 362/414; 362/344

[58] Field of Search ..... 362/376, 410, 362/414, 374, 375

[56] References Cited

U.S. PATENT DOCUMENTS

| | | | |
|---|---|---|---|
| 4,959,762 | 9/1990 | Solieau | 362/376 |
| 5,243,507 | 9/1993 | Atkins et al. | 362/376 |
| 5,660,464 | 8/1997 | Lin | 362/376 |
| 5,718,506 | 2/1998 | Yeh | 362/376 |

*Primary Examiner*—Thomas M. Sember
*Attorney, Agent, or Firm*—Bacon & Thomas, PLLC

[57] ABSTRACT

A protective screen structure adapted for use on floor lamps having a light source orienting upwardly, in particular a protective screen mounted above a lampshade to avoid contact of flammable objects with the light bulb inside the lampshade. A protective screen is provided with a retaining plate at one end of an edge thereof the retaining plate having an oval connecting hole. The protective screen further has a reed disposed at the other end of the edge. Both ends of the reed are bent to form respective positioning hooks that pass through through holes in an inner furled edge of the lampshade to pivotally connect the protective screen to the lampshade. Therefore, by pulling the retaining plate, the protective screen can be lifted pivotally from the lampshade to allow cleaning or replacement of light bulbs. The oval connecting hole of the retaining plate enables the protective screen to adapt to lampshades of different specifications.

2 Claims, 3 Drawing Sheets

FIG3-A

PROTECTIVE SCREEN STRUCTURE ADAPTED FOR USE ON FLOOR LAMPS HAVING A SOURCE OF LIGHT ORIENTING UPWARDLY

BACKGROUND OF THE INVENTION (a) Field of the Invention

The present invention relates generally to a protective screen structure adapted for use on floor lamps having a light source orienting upwardly, in particular a protective screen that can be easily and quickly lifted from a lampshade to allow cleaning or replacement of light bulbs.

(b) Description of the Prior Art

In a conventional floor lamp that has the opening of the lampshade orienting upwardly, since there is no partition between the light bulb and the surrounding, flammable objects, such as curtains, may fall on the surface of the lampshade and come into touch with the hot light bulb. After a period of time, the flammable objects may catch fire and burn, which is very dangerous.

There has been developed a kind of protective screen adapted for use with floor lamps that has the opening of the lampshade orienting upwardly, the protective screen isolating the light bulb from flammable objects. With reference to FIG. 1, a protective screen 4 is fixedly to an upper side of a lampshade 2 using screws 5 so that the light bulb inside the lampshade 2 is isolated from the outside to avoid possible danger. However, when cleaning the floor lamp or replacing the light bulb, it is necessary to loosen the screws 5 to remove the protective screen 4 since the lampshade 2 and the protective screen 4 are screwably locked together, which is very inconvenient and troublesome.

SUMMARY OF THE INVENTION

A primary object of the present invention is to provide a protective screen structure adapted for use on floor lamps having a light source orienting upwardly that is convenient and quickly to remove the protective screen for cleaning or replacement of light bulbs. According to the present invention, the protective screen is provided with a reed that passes through through holes in an inner furled edge of the lampshade, and that has positioning hooks pivotally connecting the lampshade so that the protective screen can be lifted pivotally from the lampshade after pulling a retaining plate, without the need to remove the protective screen.

Another object of the present invention is to provide a to provide a protective screen structure adapted for use on floor lamps having a light source orienting upwardly which matches lampshades of different specifications. According to the present invention, the protective screen is provided with a retaining plate having an oval connecting hole whereby the protective screen and the retaining plate can be screwably connected at the oval hole at different positions, thereby allowing the protective screen to adapt to lampshades of different specifications.

BRIEF DESCRIPTION OF THE DRAWINGS

The foregoing and other features and advantages of the present invention will be more clearly understood from the following detailed description and the accompanying drawings, in which.

FIG. 3A is an enlarged view showing the pivotal connection between the lampshade and the protective screen according to the present invention.

DETAILED DESCRIPTION OF THE PREFERRED EMBODIMENT

Figure 1:
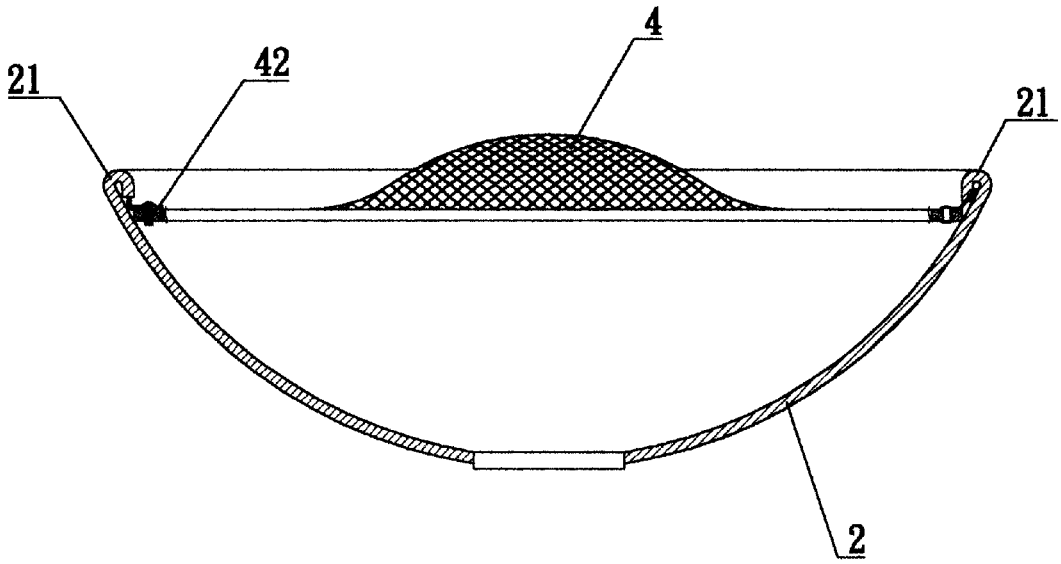
FIG. 1 is a plan assembled view of the prior art.
Figure 2:
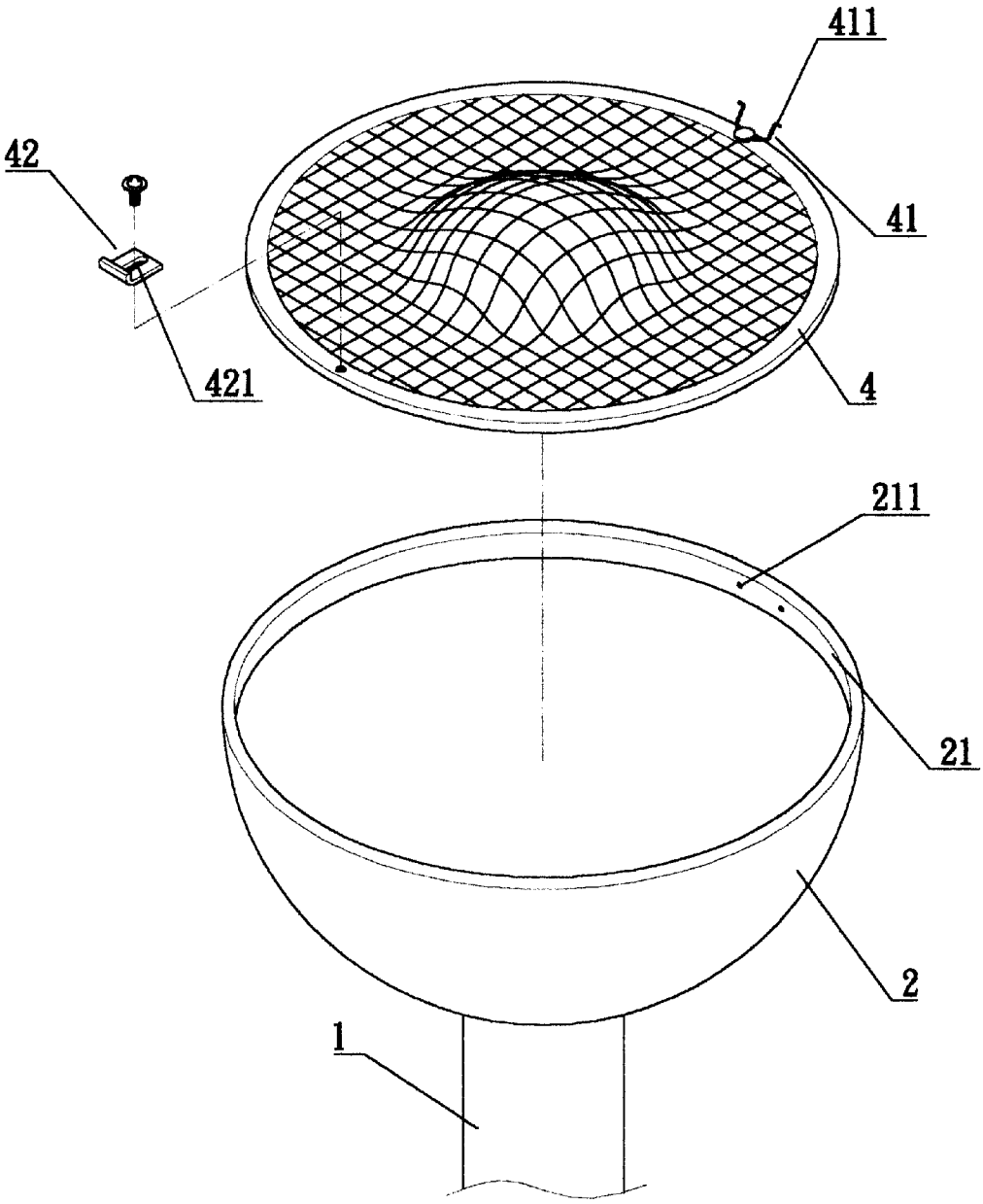
FIG. 2 is a perspective view of the lampshade according to the present invention.
Figure 3:
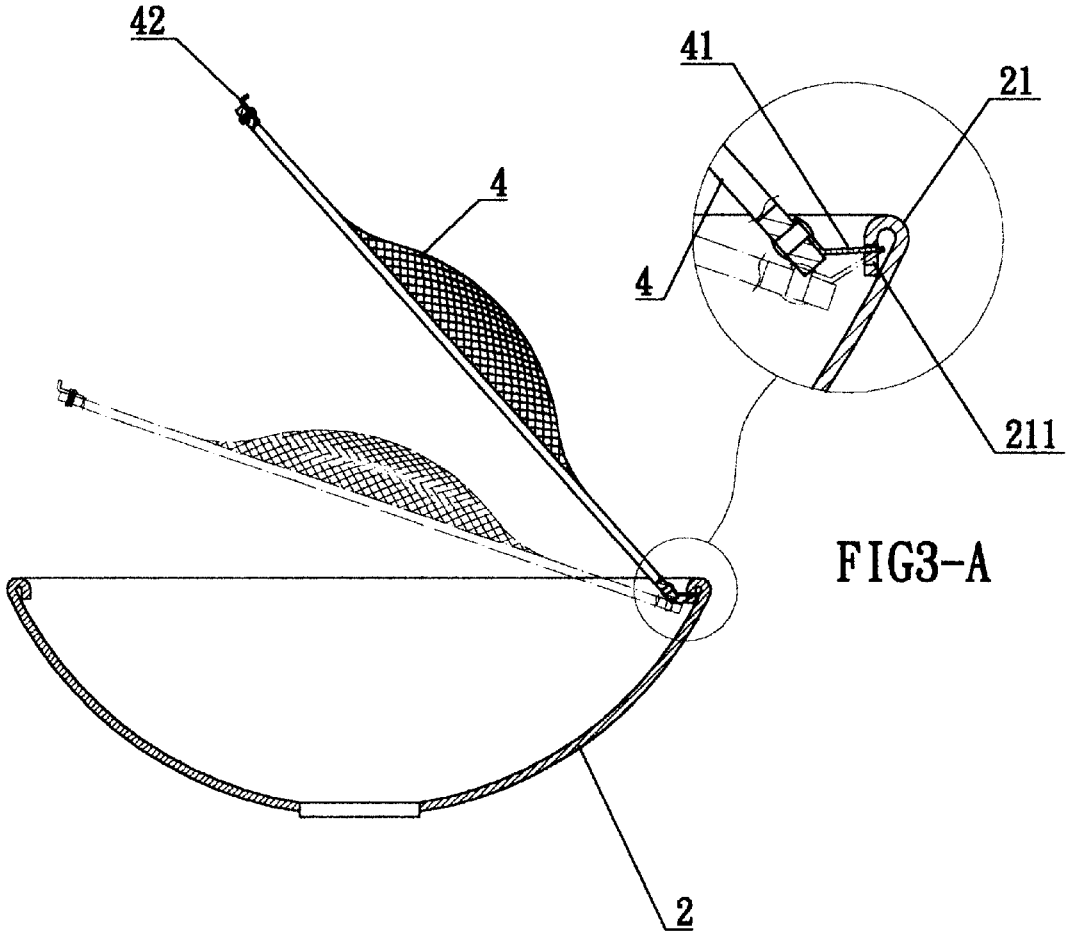
FIG. 3 is a schematic view illustrating operation of the present invention.

With reference to FIGS. 2 and 3, the present invention essentially comprises a lamp pole 1 that standing on the floor, a lampshade 2 located at a top end of the lamp pole 1, a light bulb installed within the lampshade 2, and a protective screen 4 pivotally provided on the lampshade 2.

The lampshade 2 flares upwardly with an opening facing up. The edge of the top portion of the lampshade 2 bends inwardly to form an inner furled edge 21 that is provided with through holes 211.

The screen 4 has a curved portion such that, after assembly, a space is defined between the screen 4 and the lampshade 2 for receiving the light bulb. The edge of the protective screen 4 is lockably provided with a reed 41 the two ends of which are respectively bent to form a positioning hook 411 that can pivotally connect the respective one of the through holes 211 of the inner furled edge 21 of the lampshade 2. Opposite to the reed 41 on the edge of the protective screen 4, there is further lockably provided a retaining plate 42. The retaining plate 42 is provided with an oval connecting hole 421, and is arranged such that it may just urge against the inner furled edge 21 of the lampshade 2.

By passing the reed 41 of the protective screen through the respective through holes 211 on the inner furled edge 21 of the lampshade 2, the positioning hooks 411 can be pivotally connect the protective screen 4 to the lampshade 2. Hence, it is only necessary to pull the retaining plate 42 to allow lifting of the protective screen 4 that is still held to the lampshade 2 by the pivotal end formed by the reed 41. There is no need to dissemble the whole structure to allow cleaning or replacement of the light bulb.

Furthermore, since the connecting hole 421 of the retaining plate 42 is oval in shape, by locking the protective screen 4 at different positions of the connecting hole 421, the protective screen 4 can be adapted for lampshades 2 of different specifications. There is no need to use protective screens of different specifications.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved protective screen structure adapted for use on floor lamps having a source of light orienting upwardly, comprising a lamp pole that is adapted to stand on the floor, a lampshade that is lockably provided at a top end of said lamp pole and that has an edge bending inwardly to form an inner furled edge, a light bulb that is installed within said lampshade, a protective screen that is pivotally provided on said lampshade, wherein said lampshade has through holes formed on an end of said inner furled edge thereof;

said protective screen has a reed lockably provided on an edge thereof, said reed having two ends that respectively bend to form respective positioning hooks that may pivotally connect said through holes of said inner furled edge of said lampshade; said protective screen further having a connecting hole at an end opposite to said reed, said connecting hole having a retaining plate lockably provided thereon, said retaining plate just urging against said inner furled edge of said lampshade.

2. An improved protective screen structure adapted for use on floor lamps having a source of light orienting upwardly as defined in claim 1, wherein said connecting hole of said protective screen is oval in shape or has any other equivalent geometrical shapes.

* * * * *